United States Patent [19]

Beal, Jr.

[11] Patent Number: 4,611,611

[45] Date of Patent: Sep. 16, 1986

[54] LIPSTICK APPLICATOR AND METHOD FOR MAKING SAME

[76] Inventor: Dale C. Beal, Jr., 1112 Rear Margaret St., Key West, Fla. 33040

[21] Appl. No.: 249,077

[22] Filed: Mar. 30, 1981

[51] Int. Cl.[4] ..... A45D 40/26

[52] U.S. Cl. ..... 132/88.7

[58] Field of Search ..... 132/88.7, 88.5, 79 R; 206/412; 401/49, 88

[56] References Cited

U.S. PATENT DOCUMENTS 2,735,435 2/1956 Feinstein ..... 132/88.7

2,932,841 4/1960 Graves ..... 132/79 R

*Primary Examiner*—Gregory E. McNeill

*Attorney, Agent, or Firm*—John J. Murphey

[57] ABSTRACT

A lipstick applicator constructed of a piece of paper folded over on itself to form two flaps wherein an upper and lower lip print of lip cosmetic is deposited on the facing surfaces of the flaps for applying the lip cosmetic by reverse-folding the flaps, inserting them into the mouth, fold first, and compressing the lips against them. A stack of detachable applicators may be made by placing a series of folds and parallel perforated lines in alternate sequence crosswise along a strip of paper, depositing sets of lip prints of lip cosmetic on each folded pair of flaps and folding the whole strip into an accordian-like stack so that each applicator may be torn off the end of the stack, reverse-folded, and applied to the lips.

5 Claims, 5 Drawing Figures

LIPSTICK APPLICATOR AND METHOD FOR MAKING SAME

BACKGROUND OF THE INVENTION

This invention relates to the field of applicators of lip cosmetic. More particularly, this invention relates to applicators made of flat pieces of sheet-like material such as paper, singularly or in stacked arrangement, for use by individuals to apply lipstick to their lips.

DESCRIPTION OF THE PRIOR ART

Cosmetics come in a wide variety of preparations, such as sprays, brushons, tubes, cakes, jells and pastes. Most of these preparations can be sniffed or touched to enable a person to determine whether or not the aroma and/or carrier of the cosmetic will be compatible with their body. Lipstick, however, seems to be unique in that women do not seem able to judge its desirability withhout applying it directly to their lips.

Most cosmetics are presented in stores at a general counter where there are numerous samples displayed in a glass case, behind the counter, and there are many samples on the countertop for women to sample. Although women will pick up a sample bottle of perfume that another woman has just used and spray it onto her wrist to judge the aroma or fragrance, and will also pick a stick of deodorant or other cosmetic that someone has just used and rub that stick on her hand or wrist to judge the fragrance, for some reason no woman will pick up a tube of lipstick that has been used by another woman and apply it to her lips.

Accordingly, many lipsticks are sold without a tryout of the lipstick color on one's lips. Lipsticks in their tubes are expensive because of the constituents making up the cosmetic as well as the cost to manufacture, assemble and fill the tubes. Many women will not experiment or try new colors because there is no way they will try the lipstick from a previously used sample tube and the high cost of a new tube of lipstick will cause them to remain with older, established colors thereby inhibiting the spread of new lipstick colors and formulations.

The prior art has attempted to deal with these problems with little success. Bustamante, U.S. Pat. No. 1,885,076 describes a layer of cardboard cards, half having the shape of the top lip and the other half having the shape of the bottom lip, wherein the individual cards contain lip prints of lipstick. One tears out one of the top lip cards and one of the bottom lip cards and places them in the mouth and compresses the lips against them to transfer the lip cosmetic from the card to the lips. The shortcoming here is that separate cards are needed for the top lip and bottom lip; the lipstick cannot be put on both lips in one motion and the newly applied lipstick to one lip may smudge during the application of the same lipstick to the other lip.

Sage, U.S. Pat. No. 2,606,565 attempts to deal with the problem by providing a rigid applicator containing lipstick that is placed in the mouth and swung upward against the top lip, thereby smearing a certain amount of lipstick thereon. Next, the upper lip is compressed against the lower lip to transfer some lip cosmetic thereto. The problem in this application is that the lipstick is exposed on the applicator and, where different shades are presented at a notions' counter, there would be a tendency for the individual applicators to become smeared on one another. In addition, lipstick from the upper lip has to be transferred to the lower lip by compressing the lips together and a soft, even line along the outer edge of the lower lip is not generally possible by this method.

Feinstein, U.S. Pat. No. 2,735,435 concerns a stiff disc of material folded into two curved flaps having the center portion cut out and containing a mesh fabric with lipstick embedded therein. The disc is put into the mouth and the fingers pressed against the outer portion of the mesh fabric transferring lipstick from the mesh to the lips. The shortcoming in this invention is that it is too costly to make, cannot be stacked with another disc of like size and shape, and appears to contain more lipstick than is necessary to transfer to the lips.

French Pat. No. 1,011,743 concerns a sheet of material containing cutouts in the shape of lips that are colored to simulate lipstick. The cutout portions are pressed out of the sheet and pasted on the lips so that one can look in the mirror and judge the compatibility of the color. The shortcoming in this particular aspect is that there is no lipstick put on the lips and thus the complete testing of the lipstick is not accomplished. Secondly, one use of the sheet results in all of the sheet being no longer available to the user and thus becomes wasteful. French Pat. No. 1,110,340 is directed toward a clear film with lips painted thereon in different colors where one holds the clear film in front of their lips and looks into a mirror. This has not proved effective because again, it does not deal with lipstick being applied directly to the lips and therefore a full and complete testing of the lipstick is not accomplished. Because lipsticks contain glosses and other materials that give them their individuality, it is not believed possible to completely simulate these colors on a piece of celluloid film.

Finally, Italian Pat. No. 584980 deals with a strip of material containing various lower lip prints and upper lip prints of different shades for viewing in a mirror by holding up to one's face. Again, no actual transfer of lipstick takes place and accordingly, a full and complete judgment of the compatibility or desirability of the lipstick on the individual is not accomplished.

SUMMARY OF THE INVENTION

This invention is a lipstick applicator comprising a sheet of paper folded over on itself to form two flaps where an upper lip print of lipstick is deposited on the inside of one flap and a lower lip print of lipstick is deposited on the inside of the other flap, the prints being arranged to impart a full lip print of lipstick on one's lips when the sheet is reverse-folded, placed between the lips, fold first, and thereafter the lips compressed against the flaps. The applicator is simple, light-weight, compact, and inexpensive to manufacture. It uses a minimum amount of lipstick per applicator and the lipstick is able to be quickly and accurately imparted to the lips by one simple operation. The flatness of the folded sheet of paper makes it amenable to stacking and also for displaying a wide variety of lipstick colors in a small counter area. The applicator is sanitary because the lip prints remain folded inside the sheet until ready for use and after use, the applicator is thrown away. In addition, the sheet of paper may be colored to provide ready index to consumers for various colors and further, the applicator is a convenient vehicle for depositing different colors and different patterns of lipstick to the upper and lower lips.

Accordingly, one object of this invention is a simple, compact, light-weight and low cost applicator for lip cosmetics. Another object is a lipstick applicator that requires a minimum amount of lipstick that can be used quickly and accurately and thereafter dispensed with to maintain sanitary facilities in the area of lipstick testing. A further object of the invention is an applicator for providing accurate prints of lipstick quickly and accurately to one's lips without involving the use of films, brushes, tubes or messy applicators and, further, that eliminates the need for smearing lipstick from one lip to another to complete the lipstick application. A still further objective of this invention is an article of manufacture comprising detachable sheets of folded paper, each individual applicator containing a full set of lip prints and being attached to the next applicator through a line of perforations so that a stack of the applicators may be maintained in a convenient dispensing container and the individual applicators torn from the stack, reverse-folded and applied to the lips. These and other objects will appear more clearly below in the description of the preferred embodiments that is to be read along with the drawings that are made a part hereof, concluding with claims to the novel aspects of this invention.

DESCRIPTION OF THE PREFERRED EMBODIMENTS

Figure 1:
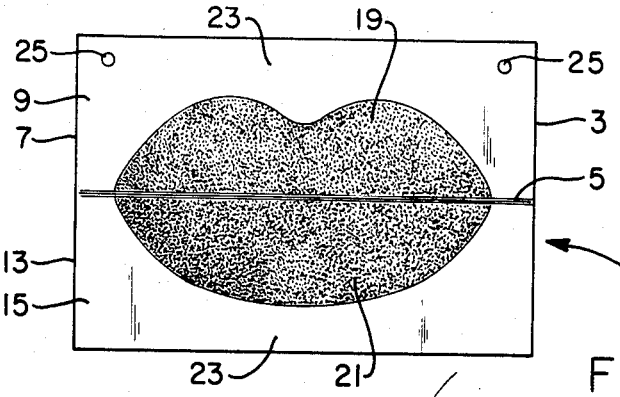
FIG. 1 is a top view of a lipstick applicator opened out that is one embodiment of this invention.

FIG. 1 shows a lipstick applicator 1 folded open and comprises a sheet member 3 bisected by a fold 5, generally dividing member 3 in half to form a first flap 7 comprising an upper surface 9 and a lower surface 11 (see FIG. 2), and a second flap 13 comprising an upper surface 15 and a lower surface 17 (see FIG. 2) in hinged relationship. Sheet member 3 may be of virtually any foldable sheet material such as paper, wax paper, plastic film, or others; however, paper treated with known ingredients to render it impervious to the absorption of waxes and oils from lip cosmetic formulations are preferred so that bleeding of lipstick constituents into the paper is avoided.

FIG. 1 further shows an upper human lip print 19 of lipstick on upper surface 9 of first flap 7. A lower human lip print 21 of lipstick is placed on the opposite side of fold 5 on upper surface 15 of second flap 13.

The pair of lip prints 19 and 21 are centered along fold 5 and inside the edges of sheet member 3 to provide a clear perimeter 23 around the outside of the prints to eliminate smudging thereof during handling.

Figure 2:
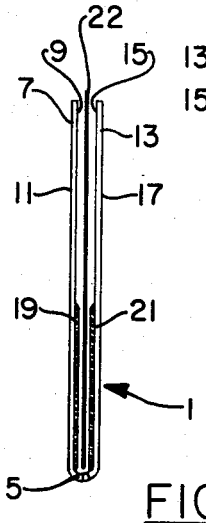
FIG. 2 is a side view of the lipstick applicator in FIG. 1 in its folded state.
Figure 3:
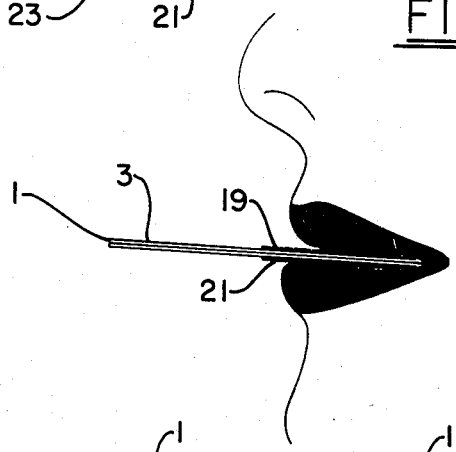
FIG. 3 is a drawing of a person using the lipstick applicator shown in FIGS. 1 and 2.

Referring to FIG. 2, lipstick applicator sheet member 3 is shown folded into its storage form by folding first flap 7 over onto second flap 13 so that upper and lower lip prints 19 and 21 respectively are protected inside sheet member 3. An optional embodiment is to place a thin sheet of protective film 22, such as wax paper, cellophane or Mylar (trademark), between upper and lower lip prints 19 and 21 to help prevent smearing of the prints. As shown in FIG. 1 and FIG. 3, lip prints 19 and 21 are arranged to conform to the mouth and to impart a lip print of lipstick on one's lips when sheet member 3 is reverse-folded to place upper lip print 19 and lower lip print 21 on the exposed reverse surfaces, and sheet member 3 placed between the lips, fold first, and the lips compressed thereagainst. When optional protective film 22 is used, it of course must be discarded before application of the lipstick to the lips.

Another form of storing applicator 1 is to leave it unfolded as shown in FIG. 1 and form a pair of apertures 25 in the upper corners of first flap 7 that would receive therethrough a rod or other holding device mounted horizontally above a notions' counter. Applicator 1 could be readily removed from such a holder by pulling lower or second flap 13 downward thereby tearing the sheet member 3 from the holder through rupturing apertures 25.

The print of lip cosmetic or lipstick may be easily and conveniently applied to first and second flaps 7 and 13 by any convenient means, such as printing by flat-bed press, rotary press, web press, or other known printing process such as silk screening, etc. In addition, the lip prints may be diestamped embossed to form a lip print impression and then the lipstick printed or deposited in the impression. Another aspect of this invention is to subject lipstick prints 19 and 21 to flame-hardening, which is a known process in the lip cosmetic industry, whereby lipstick is subjected to exposure to a flame to provide a smooth, non-smudging surface to the print.

Figure 4:
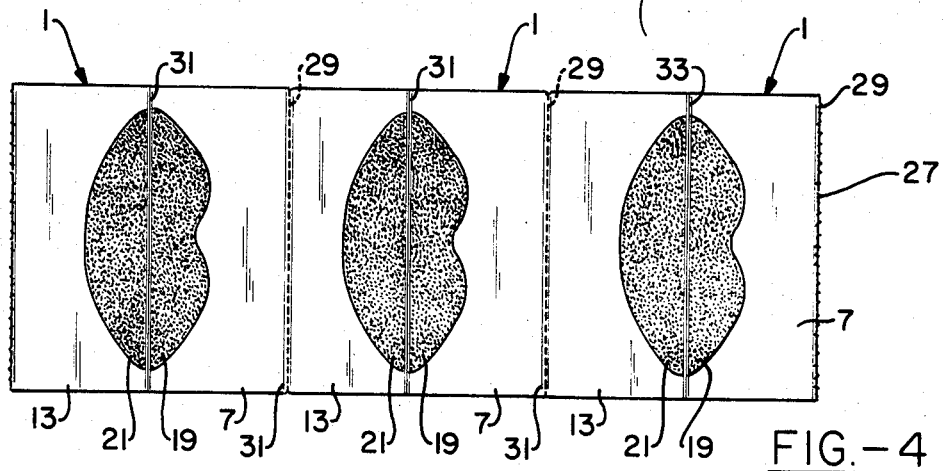
FIG. 4 is a top view of another embodiment of this invention.

FIG. 4 is another embodiment of this invention and shows an elongated strip or sheet member 27, similar to sheet member 3 in FIG. 1, divided by alternate parallel lines of perforations 29 and folds 31 to form a series of detachable lipstick applicators 1. Between each pair of perforation lines 29 is a lipstick applicator similar to applicator 1 shown in FIG. 1. Each applicator comprises first and second flaps 7 and 13 respectively separated by a fold 31 so that after deposit of the lip prints thereon said flaps 7 and 13 may be folded at an acute angle to each other to form an accordian-like stack 33 of applicators (see FIG. 5). On flaps 7 and 13 are formed respectively upper surface 9 and lower surface 11 (not shown) and upper surface 15 and lower surface 17 (not shown). An upper human lip print of lipstick 19 is deposited by printing methods, as aforesaid, on upper surface 9 of each first flap 7. A lower human lip print of lipstick is also deposited on upper surface 15 of each second flap 13 and arranged to impart a full upper and lower lip print of lipstick on one's lips when a lipstick applicator 1 is torn loose from elongated sheet member 27 at a perforated line 29, reverse-folded and placed between one's lips, fold first, and the lips compressed thereagainst. The individual separably folded lipstick applicators 1 shown in the accordian-like stack 3 shown in FIG. 5 may be conveniently housed in a vertically oriented square or rectangular cross-sectional cardboard tube (not shown) having an opening at the bottom thereof wherein each folded sheet applicator 1 may be conveniently torn from the stack at the bottom, reverse-folded and applied to one's lips such as in a department store counter for sampling of that particular lipstick. Such container is well known in the art and does not form a part of this invention.

Figure 5:
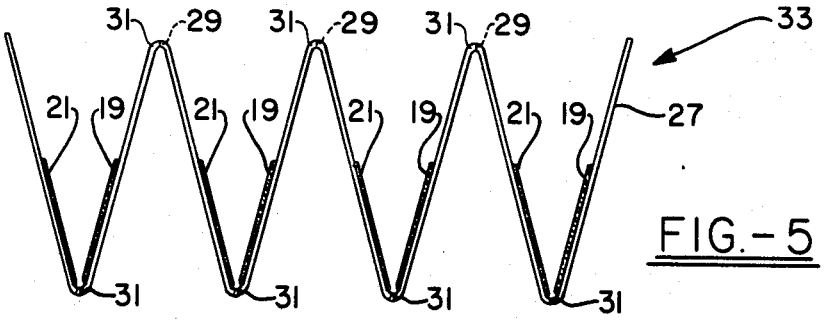
FIG. 5 is a side view of the embodiment shown in FIG. 4 in a folded state.

An elongated strip of sheet material may be conveniently processed into the accordian-like structure 33 shown in FIG. 5 by forming a series of parallel folds and lines of perforations in alternating sequence, crosswise or perpendicular along the length of elongated sheet member 27 by any convenient method such as roll processing or other endless folding and perforating process; depositing repetitive sets of full upper and lower human lip prints 19 and 21 respectively, of lip cosmetic on one side of said elongated sheet member 27 by any convenient and conventional printing method as previously described, said prints arranged so that the alternate fold lines 31 transversely divide the two lips in each set. Elongated strip 27 is then folded at fold lines 31 into an accordian-like stack 33 wherein the upper and lower lip prints 19 and 21 in each set face each other and all the lines of perforations 21 are on one side of stack 33 so that each set of lip prints, in the form of applicators 1, may be torn from the stack at perforations 29.

In the aforesaid process, a separate step may be inserted between the strip of depositing repetitive sets of full upper and lower human lip prints on said strip and folding said strip into an accordian-like stack. That extra step would be to subject the newly deposited upper and lower lip prints of lip cosmetic to flame hardening to provide a glossy surface of slightly hardened lip cosmetic to render the lip prints resistant to smudging when they are folder together.

What is claimed is:

1. A lipstick applicator comprising:

(a) a flat sheet of film folded over on itself to form two adjacent flaps;

(b) an upper full lip print of lipstick on the inside of one flap extending to the fold;

(c) a lower full lip print of lipstick on the inside of the other flap extending to the fold;

(d) the prints arranged to accurately impart a full lip print of lipstick on one's lips when the sheet is reverse-folded, placed flat between the lips, fold first, and the lips compressed thereagainst.

2. The applicator of claim 1 including a sheet of film between said upper lip print and said lower lip print to aid in preventing smearing therebetween.

3. An article of manufacture comprising:

(a) an elongated flat sheet member divided by alternate parallel lines of perforations and folds and folded to form an accordian-like stack of detachable flat folded sheet members wherein each folded sheet member comprises two flaps, at an angle to each other, having first and second flap surfaces facing each other;

(b) an upper full human lip print of lipstick on the inside of every first flap surface extending to the fold; and (c) a lower full human lip print of lipstick on the inside of every second flap surface, extending to the fold, said lip prints arranged to accurately impart a full upper and lower lip print of lipstick on one's lips when the folded sheet member is torn loose from the stack at the perforated line, reverse-folded flat and placed between one's lips, fold first, and the lips compressed thereagainst.

4. The article of manufacture of claim 3 including a sheet of film between said upper human lip print and said lower human lip print to aid in preventing smearing therebetween.

5. A method of making a stack of detachable folded lipstick applications comprising:

(a) forming parallel folds and lines of perforations in alternate sequence crosswise along the length of a strip of sheet material;

(b) depositing repetitive sets of full upper and lower human lip prints of lip cosmetic on one side of said strip arranged so that the alternate fold lines transversely divide the two lips in each set; and, (c) folding said strip into an accordian-like stack wherein the upper and lower lip print in each set face each other and all the lines of perforations are on one side of said stack so that each set of lip prints may be detached from said stack at the perforations, reverse-folded, placed flat between the lips, fold first and the lips compressed thereagainst to accurately impart a full lip print of lipstick on one's lips.

* * * * *